US010415229B2

(12) United States Patent
Roper

(10) Patent No.: US 10,415,229 B2
(45) **Date of Patent: *Sep. 17, 2019**

(54) SEWAGE SYSTEM AGITATOR

(71) Applicant: John O. Roper, Fountain Inn, SC (US)

(72) Inventor: John O. Roper, Fountain Inn, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/710,450

(22) Filed: Sep. 20, 2017

(65) Prior Publication Data

US 2018/0010326 A1 Jan. 11, 2018

Related U.S. Application Data

(63) Continuation-in-part of application No. 15/075,415, filed on Mar. 21, 2016.

(51) Int. Cl.

| | |
|---|---|
| ***B01F 5/00*** | (2006.01) |
| ***E03F 5/26*** | (2006.01) |
| ***B05B 12/02*** | (2006.01) |
| ***B05B 13/02*** | (2006.01) |
| ***B01F 3/08*** | (2006.01) |
| ***B01F 15/00*** | (2006.01) |
| ***B01F 15/02*** | (2006.01) |
| ***B01F 5/02*** | (2006.01) |
| ***E03F 5/22*** | (2006.01) |

(52) U.S. Cl.

CPC ..... *E03F 5/26* (2013.01); *B01F 3/0865* (2013.01); *B01F 5/0057* (2013.01); *B01F 5/0062* (2013.01); *B01F 5/02* (2013.01); *B01F 15/00155* (2013.01); *B01F 15/00253* (2013.01); *B01F 15/0254* (2013.01); *B01F 15/0283* (2013.01); *B05B 12/02* (2013.01); *B05B 13/0278* (2013.01); *E03F 5/22* (2013.01); *B01F 2215/0052* (2013.01)

(58) Field of Classification Search

CPC ..... B01F 5/0062
USPC ..... 366/153.1, 190
See application file for complete search history.

(56) References Cited

U.S. PATENT DOCUMENTS

| | | | | |
|---|---|---|---|---|
| 6,868,857 | B2 | 3/2005 | McCasker | |
| 7,082,952 | B1 | 8/2006 | McCasker et al. | |
| 8,376,254 | B2 * | 2/2013 | Hatten | B05B 3/063 241/46.017 |
| 9,139,457 | B2 * | 9/2015 | Hatten | C02F 1/008 |
| 2012/0267318 | A1 * | 10/2012 | Hatten | G05D 11/135 210/744 |
| 2013/0068308 | A1 | 3/2013 | Padgett, Jr. | |

FOREIGN PATENT DOCUMENTS

| | | |
|---|---|---|
| AU | B3985693 | 2/1993 |

* cited by examiner

*Primary Examiner* — David L Sorkin
(74) *Attorney, Agent, or Firm* — JK Intellectual Property Law, PA

(57) ABSTRACT

A sewage system component spray assembly is attached at a predetermined height above pumps in the interior of the component and has at least one nozzle for spraying liquid downwardly and generally tangential to a center of the sewage system component. Operation of the nozzle causes the liquid to disperse floating material on the sewage surface and creating a rotational flow around the center to direct such material to the pumps. The source of the sprayed liquid may be internal to the sewage system component.

6 Claims, 8 Drawing Sheets

SEWAGE SYSTEM AGITATOR

CROSS-REFERENCE TO RELATED APPLICATIONS

The present application is a continuation-in-part application of and claims priority to co-pending U.S. patent application Ser. No. 15/075,415, filed Mar. 21, 2016, which application is also incorporated by reference herein.

TECHNICAL FIELD

The present disclosure relates to an agitator for a sewage system component such as a pumping station.

BACKGROUND

Sewage systems remove waste via flow of water and other entrained material through pipes to sewage treatment plants. Generally, the flow is moved in a desired direction by arranging the pipes so that gravity draws the flow "downhill." At times assistance is provided by sewage pumps, for example, to urge flow along and/or to lift flow to a higher level where gravity based flow starts again. Such pumps may be located in a structure along the sewer line in structures commonly known as a wet well, a lift station, or a pumping station.

Such pumps are electrically operated and are often automatically turned on and off by sensors such as float switches, proximity switches, probes, or the like. For example, when a sensor notes that material in a pumping station has reached a first predetermined (full) level, the pumps operate to pump out the material. During pumping, when another sensor notes that material has fallen to a second predetermined (empty) level, the pumps cease operation. Even at an "empty" level in the pumping station, some material remains as the pump inlets are arranged so as to remain under the surface of the liquid to prevent malfunction. This operation continues and the pumping station is sequentially filled by flow and then pumped out by the pumps.

Sewage contains various substances, such as waste, fats, greases, grit, and slime, etc. Some of such substances will float on top of the liquid in the pumping stations and therefore not reach the pump inlets. The substances can build up over time requiring chemical treatment and/or regular mechanized or manual removal. Such substances can also form hardened conglomerations over time. Such masses may eventually block pump inlets, or may be drawn through the inlets into the pumps, thereby causing clogging or damage. Fats and greases, for example, are known to float and collect into large somewhat solid clumps that can be problematic in this way.

Accordingly, improvements in pumping stations that provide more reliable and/or less labor-intensive operation addressing one or more drawbacks of current systems or other issues would be welcome.

SUMMARY

According to certain aspects of the disclosure, a sewage system component may include a container for receiving a flow of sewage, the container defining a central axis; at least one first pump in the container for pumping sewage out of the container, the first pump operational to pump sewage when the sewage is at a first height until the sewage is at a second height lower than the first height; a spray device mounted in the container at a predetermined height between the first height and the second height; and a second pump in the container for pumping liquid from the sewage in the container to the spray device. The spray device has a nozzle directed downward and generally tangential to a circle around the central axis. Operation of the spray device disperses floating material on the sewage surface and creating a rotational flow around the central axis to assist the first pump in removing such material when the first pump pumps the sewage. Various options and modifications are possible.

According to certain other aspects of the disclosure, a spray assembly for an interior of a sewage system component having a first pump therein may include a mount for attachment at a predetermined height above the first pump in the interior of the sewage system component; a nozzle connected to the mount for spraying a liquid downwardly and generally tangential to a center of the sewage system component, operation of the nozzle causing the liquid to disperse floating material on the sewage surface and creating a rotational flow around the center to direct such material to the first pump; and a second pump in the sewage system component for pumping the liquid from the sewage system component to the nozzle. Various options and modifications are possible.

According to another aspect of the disclosure, a method of emptying a sewage system component may include sensing that the sewage system component is filled to a first level; pumping sewage from the sewage system component after the sensing step using a first pump; sensing when, during the pumping step, the sewage level has dropped to a predetermined level lower than the first level; spraying a liquid pumped from the sewage system component using a second pump, during the pumping step and after the sensing of the predetermined level, with a nozzle located above the predetermined level downwardly and circumferentially within the sewage system component with enough force to disperse floating matter and cause rotation within the sewage system component; and continuing to operate the first pump and the second pump until the sewage level has dropped to a second level lower than the predetermined level. Various options and modifications are possible.

BRIEF DESCRIPTION OF THE DRAWINGS

More details of the present disclosure are set forth in the drawings.

DETAILED DESCRIPTION

Figure 1:
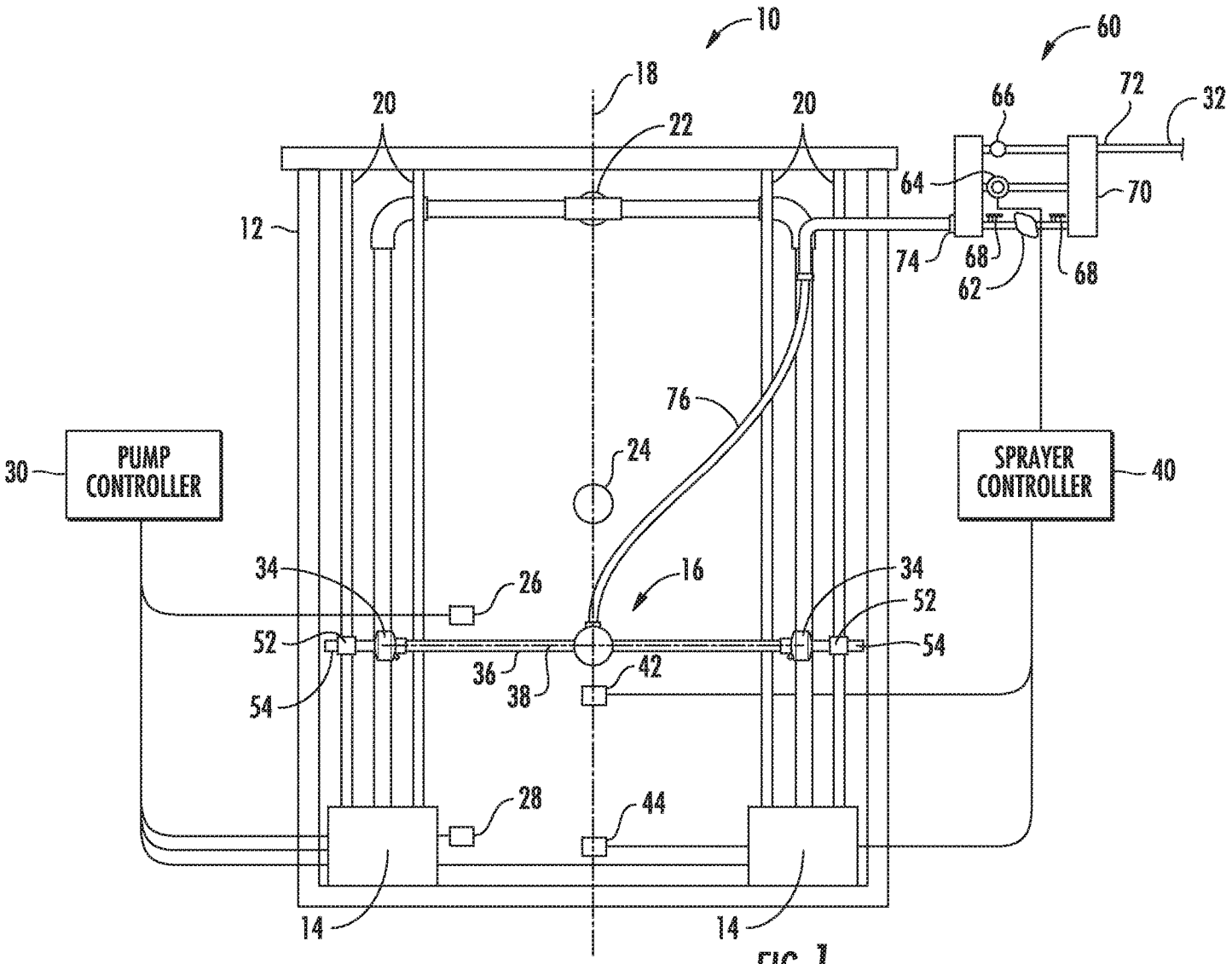
FIG. 1 is a diagrammatical side view of a pumping station incorporating an agitator according to a first embodiment of the disclosure.
Figure 2:
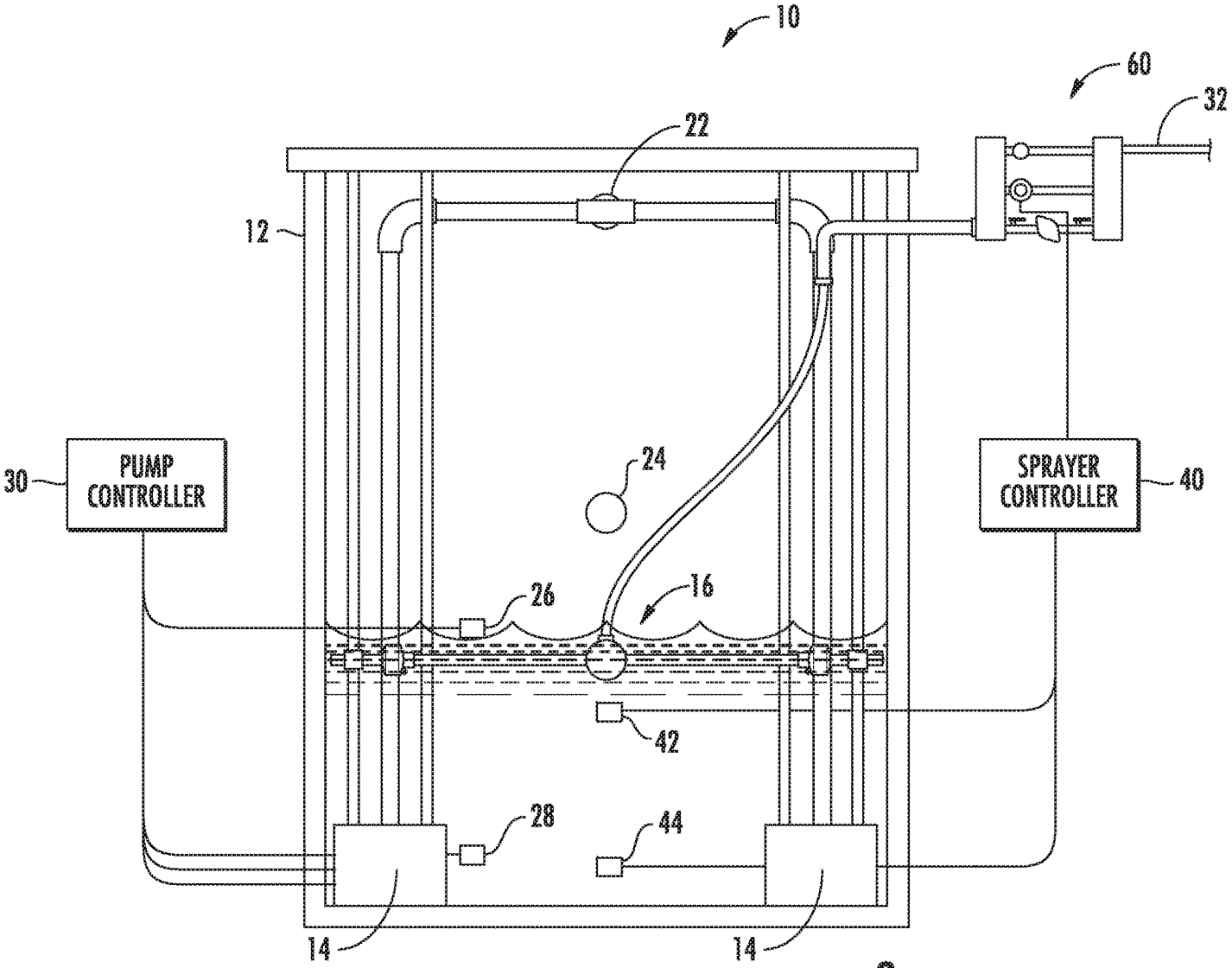
FIG. 2 is a diagrammatical side view of the pumping station as in FIG. 1, showing a water level in the tank higher than the agitator spray head.

Detailed reference will now be made to the drawings in which examples embodying the present disclosure are shown. The detailed description uses numeral and letter designations to refer to features in the drawings. Like or similar designations in the drawings and description have been used to refer to like or similar parts of the disclosure.

The drawings and detailed description provide a full and enabling description of the disclosure and the manner and process of making and using it. Each embodiment is provided by way of explanation of the subject matter not limitation thereof. In fact, it will be apparent to those skilled in the art that various modifications and variations may be made to the disclosed subject matter without departing from the scope or spirit of the disclosure. For instance, features illustrated or described as part of one embodiment may be used with another embodiment to yield a still further embodiment.

Generally speaking, FIGS. 1-10 depict examples of a sewage system component such as a pumping station 10,10' including a container 12 for receiving a flow of sewage, at least one pump 14 for pumping sewage out of the container, and a spray device (agitator spray head) 16,16' mounted in the container for spraying the sewage at a predetermined time.

Figure 10:
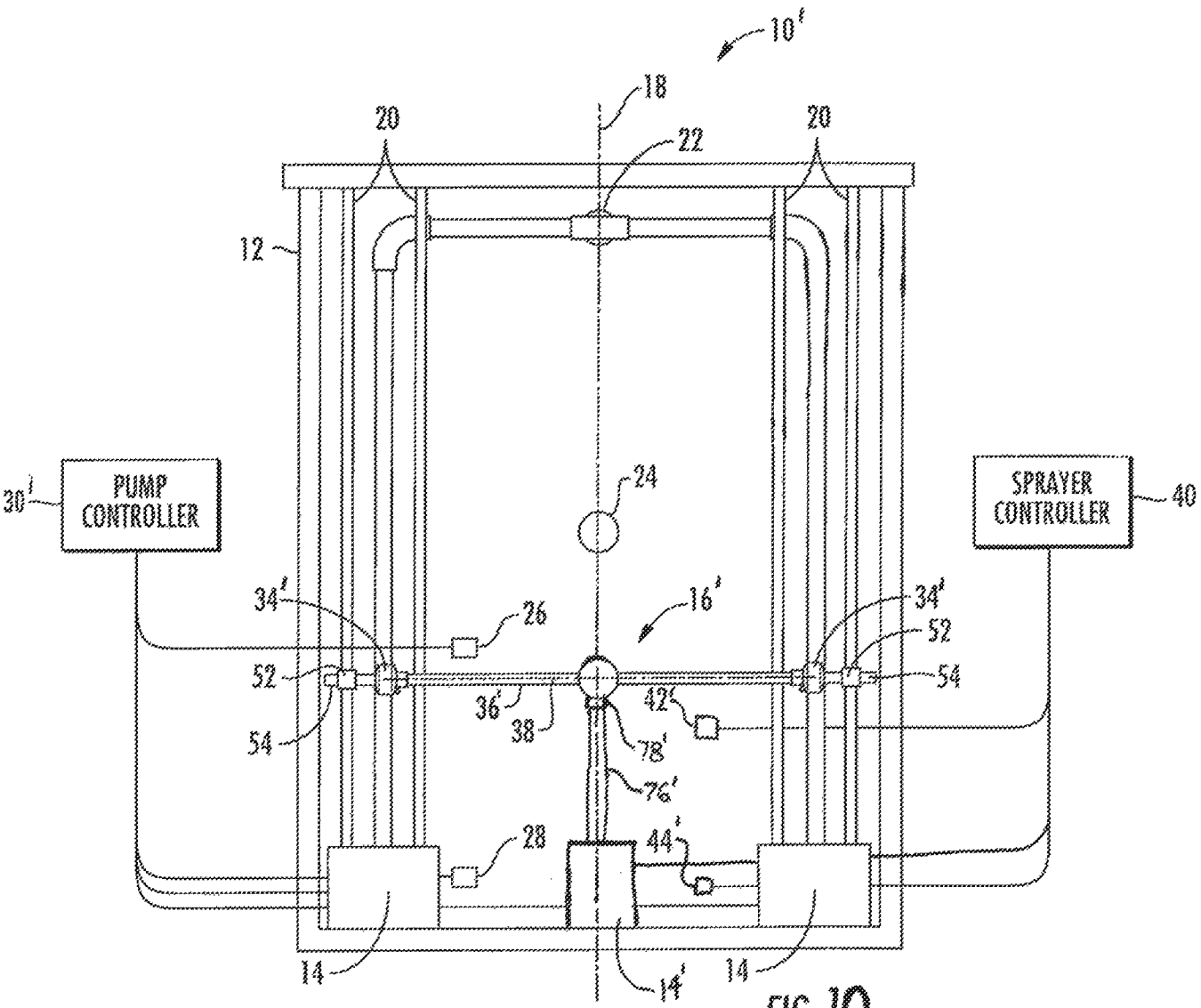
FIG. 10 is a diagrammatical side view of a pumping station incorporating an agitator according to a second embodiment of the disclosure.

Pumping station 10' of FIG. 10 is substantially similar to pumping station 10 of FIGS. 1-9, except for modifications to souring liquid to the spray devices 16,16'. Accordingly, discussion of pumping station 10' below is abbreviated for clarity to include only important differences legally required to appear in this disclosure.

Returning to FIGS. 1-9, component/container 12 can be any type of sewage carrying or water treatment tank, container, etc. Thus, container 12 can be any type of container located along a sewer line, such as those commonly called a wet well, a pumping station, a lift station, a vault, etc. At times such terms are often used inconsistently or interchangeably in the field. Typically, containers are formed of concrete, and are circular in cross-section, sometimes cylindrical and sometimes varying in diameter along their height. Container 12 is illustrated herein as a cylinder. Container 12 may also be a tank, lagoon, or holding pond in a water treatment facility. However, no limitation should be made as to the type, shape, construction material, etc., of such container. Further, although a central axis 18 of container 12 is discussed herein, such does not require that container 12 is cylindrical or circular in cross section. Central axis 18 merely refers to a generally middle point of container 12, extending upwardly.

The present disclosure shows two of the pumps 14, which is conventional in pumping stations. One skilled in the art can readily select one or more suitable pumps 14 for station 10 from commercially-available sources, in view of the size, head, desired flow rate, expected contents of the flow, duty cycle, etc. Pumps 14 are positioned in container 12 on conventional vertical guide rails 20. Pumps 14 may be slidable along guide rails 20 or fixed to guide rails 20 as desired, for placement and removal within container 12. As illustrated, each pump 14 is mounted along two of the guide rails 20, although other numbers of guide rails, or no guide rails, could be used.

Pumps 14 periodically pump sewage out of container 12 out of common outlet 22 after the container fills via inlet 24. Outlet 22 as illustrated is higher within container 12 than inlet 24, although it need not be.

Pumps 14 pump sewage when the sewage is at a first height until the sewage is at a second height lower than the first height First height is any desired height within container at which pumping is desired. First height may be the height of sensor 26, which is illustrated as below the height of inlet 24 but need not be. Second height may be the height of sensor 28, which is illustrated at or near the bottom of container 12 but need not be. Sensors 26 and 28 may be any suitable type of sensor such as float switches, reverse float switches, liquid sensors, visual sensors, etc. Pumps 14 and sensors 26 and 28 are connected to a conventional pump controller 30. Additional sensors (not shown) may also be provided at different locations or heights and connected to controller 30 to obtain more information and/or fine tune operation of the pumping station, as is conventionally known.

Accordingly, during typical operation of pumping station 10, sewage flows into inlet 24 until the level reaches first height and is sensed by sensor 26. When sensor 26 notes sewage has reached that level, it signals controller 30, which in turn signals pumps 14 to operate until sensor 28 detects that the level of sewage has fallen to the second height. Sensor 28 signals such to controller 30, which then turns off pumps 14. This filling and emptying cycle repeats as needed.

Strictly speaking, sensors 26 and 28 are not required for all aspects of the present invention, but are explained here to show one typical installation of a spray device 16 within a container. Thus, pumps 14 can be operated on other bases (i.e., other sensors, timers, etc.) within the scope of the invention.

Spray device 16 is mounted in container 12 at a predetermined height between the first height (e.g., the height of sensor 26) and the second height (e.g., the height of sensor 28). The predetermined height may be between 6 to 12 inches above pumps 14, for example. Spray device 16 is connected to a source of liquid 32. The liquid may be a source of mains water, a dedicated water tank, water treated with chemicals for any purpose used in sewage systems, and/or liquid within the container (as in FIG. 10).

Spray device 16 has at least one nozzle 34 directed generally downward and/or at least partially tangential to a circle around central axis 18 of container 12 (see FIGS. 5 and 7-9). As illustrated, spray device 16 includes two such nozzles 34, each mounted to an end of a conduit 36 extending substantially horizontally with an axis 38 extending therealong. If desired, nozzles 34 may be rotational relative to axis 38 to fine tune the angle of spray relative to the sewage to suit a particular installation. Such rotational function may be provided by threading or a rotational seal existing between nozzles 34 and conduit 36, or between conduit 36 and cross-piece 46.

Figure 3:
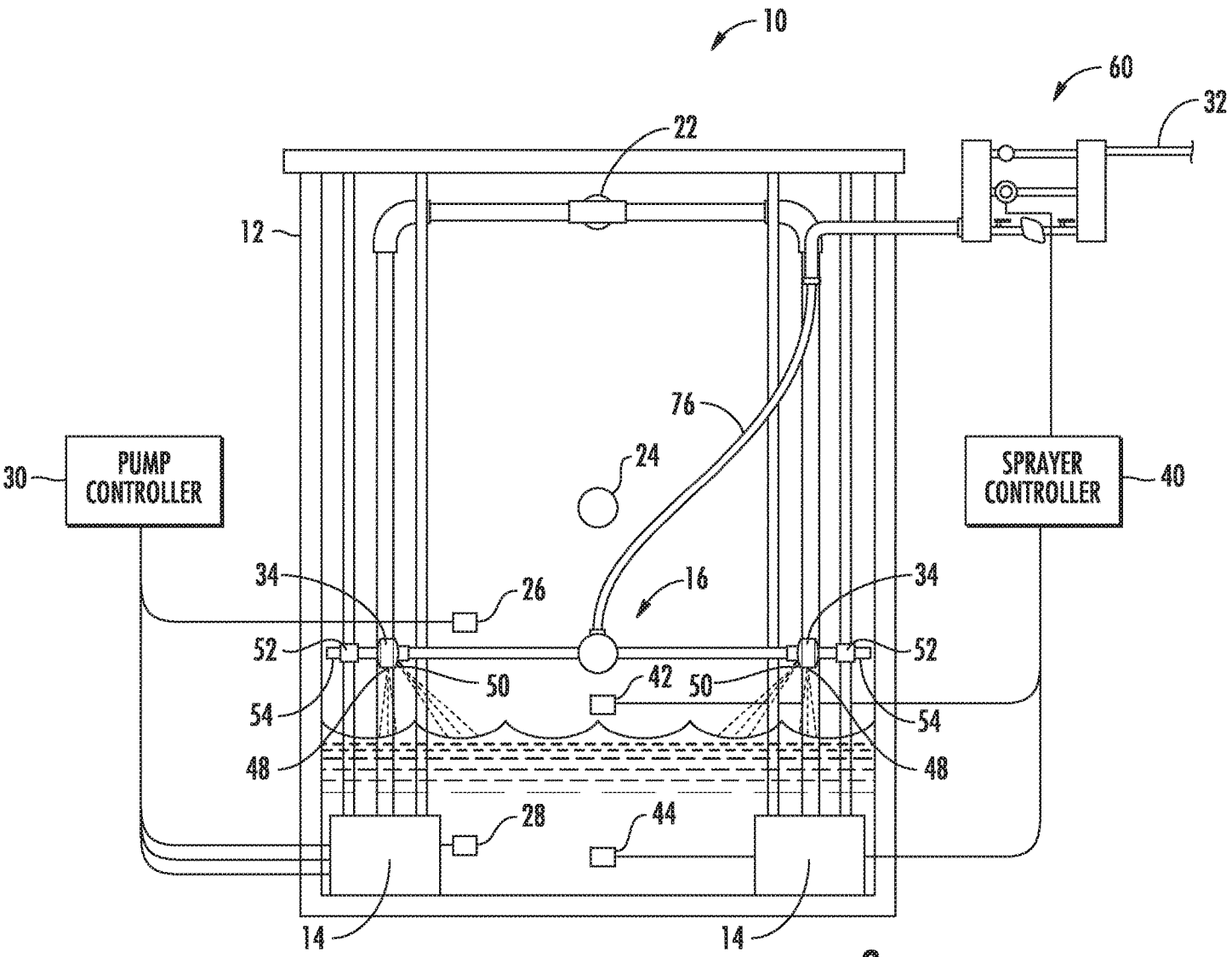
FIG. 3 is a diagrammatical side view of the pumping station as in FIG. 1, showing a water level in the tank just below the agitator spray head an showing an agitator head spray pattern.
Figure 4:
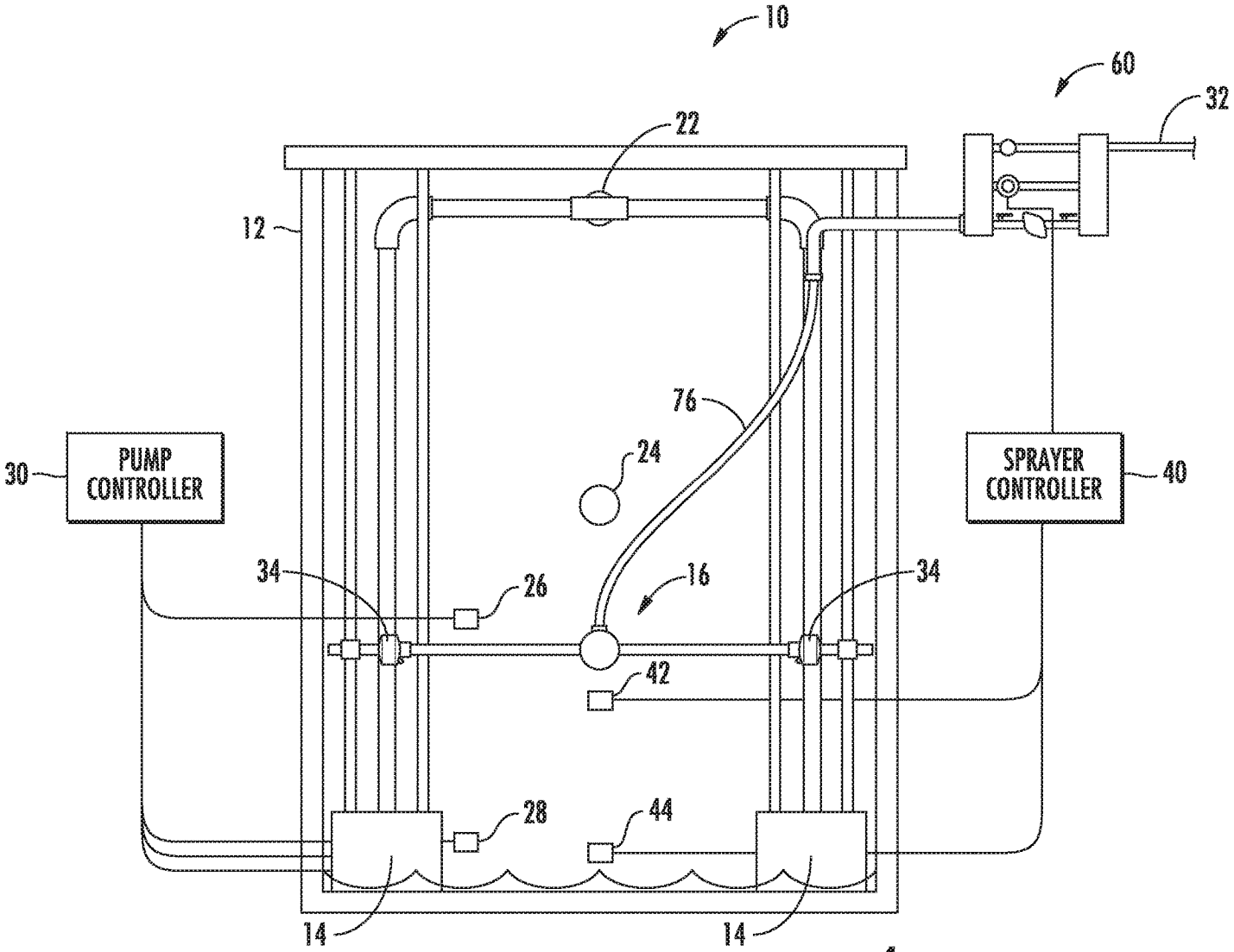
FIG. 4 is a diagrammatical side view of the pumping station as in FIG. 1, showing a water level near the bottom of the tank.
Figure 5:
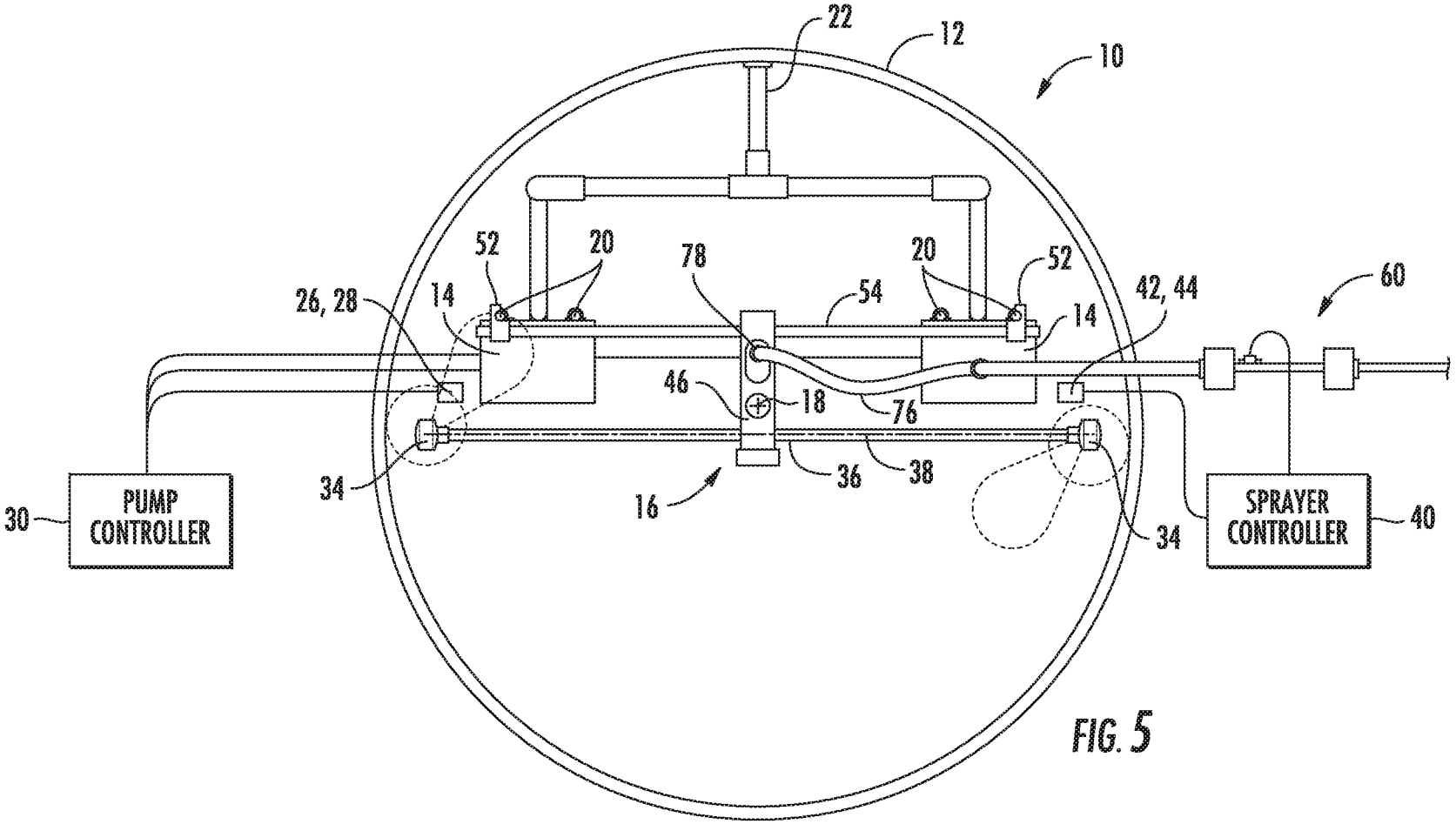
FIG. 5 is a diagrammatical top view of the pumping station as in FIG. 1, showing an agitator head spray head pattern.
Figure 6:
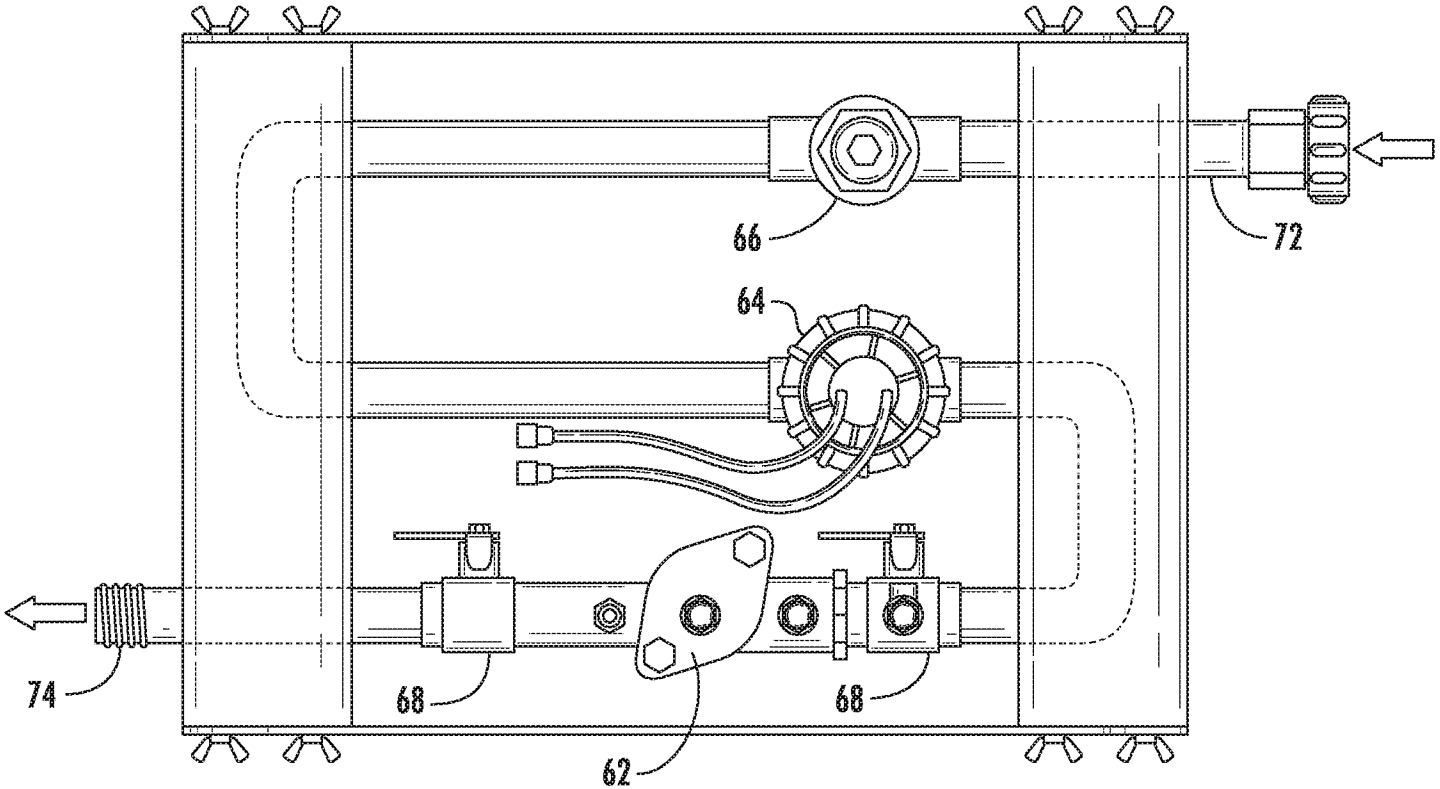
FIG. 6 is a side view of a control valve of the agitator as in FIG. 1.
Figures 7, 8, 9:
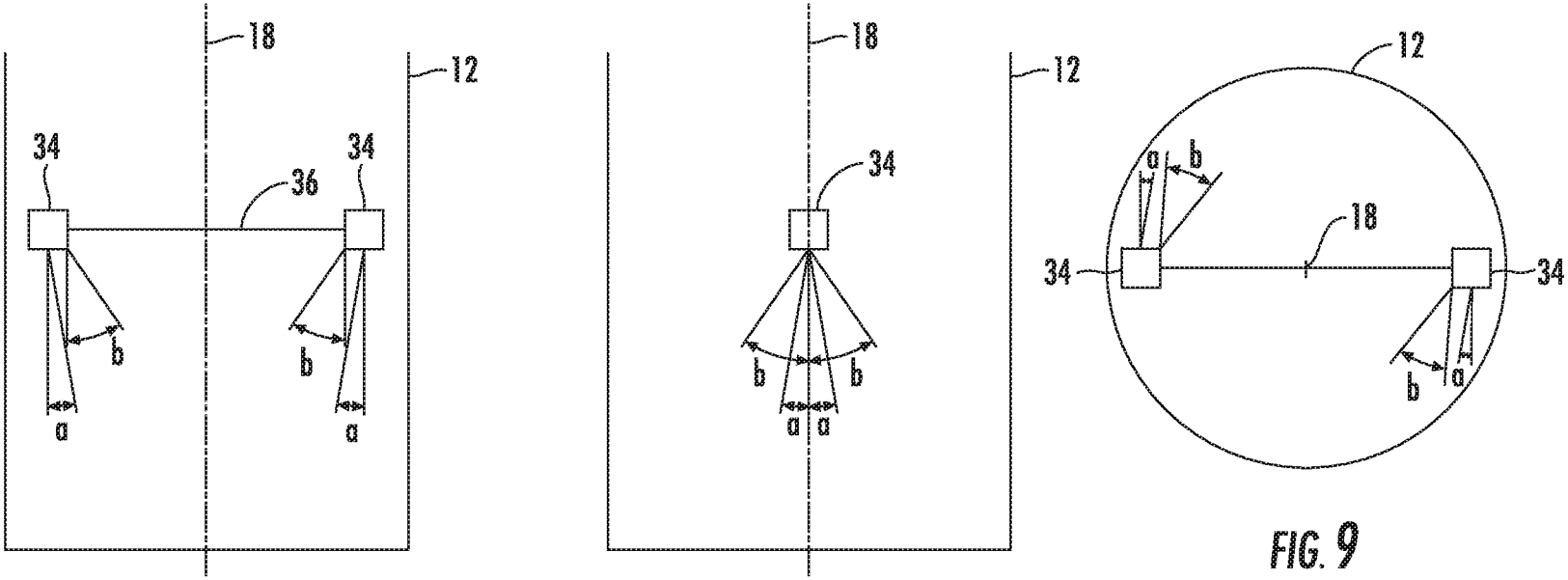
FIGS. 7 and 8 are simplified side geometrical views (90 degrees apart) showing spray angles of the agitator spray head.
FIG. 9 is a simplified top geometrical view showing spray angles of the agitator spray head.

Spray device 16 sprays generally downward and slightly rotationally relative to axis 18 once the level of the sewage has dropped to a level slightly below the spray device (see FIG. 3). Using two nozzles 34 spraying circumferentially the same rotational direction (clockwise or counterclockwise) assists in creating fluid rotation within container 12. Such spray disperses floating material on the sewage surface and creates a rotational flow around the central axis 18 to assist pumps 14 in removing such material when pumping. The rotation of liquid assists in getting more floating material to pass nozzles and be sprayed and dispersed, as compared to using two fixed spray nozzles pointing only straight down. Such spraying continues until either the pumps stop due to sensor 28 and/or a spray stop level is reached.

Using a fixed spray device 16 with circumferentially angled spraying, rather than a rotational spray device with straight down spraying, provides a simplified and more reliable structure. This is particularly true because the spray device is most efficient and effective if located vertically relatively near the pumps toward the bottom of container 12. Such location is therefore often covered with sewage before pumping occurs, and a rotational mechanism at such location might become damaged, degraded, or impeded by spending time submerged in the sewage. Also, more force is transmitted by the pressurized sprayed water to the sewage by using a fixed but angled sprayer, as opposed to using a rotational sprayer, in which some of the water pressure force is used to create rotation of a spray head.

As illustrated, a spray controller 40 is provided along with sensors 42 and 44 to control starting (sensor 42) and stopping (sensor 44) of spray device 16. It should be understood that controllers 30 and 40 could be a single controller, or could be separate controllers housed in a single housing. Controllers 30 and 40 if separate can be operated jointly or separately, and sensors 26, 28, 42 and 44 can be tied together into one system or two. Also, an individual sensors can be used for both the pumping system/controller and the spraying system/controller. Also, sensors 28 and 44, for example, could comprise the same sensor. Therefore, many modifications of the sensing and control functions of both the pumping and spraying systems are possible. Using a separate sprayer controller 40 and sensors 42 and 44, although not necessary in all aspects, provides the benefits of ease of retrofitting existing systems and certain optional choices during installation.

If desired, each nozzle 34 may include a first outlet 48 and a second outlet 50 to provide more spray coverage into the sewage container 12. As illustrated, first outlet 48 may be oriented up to about 10 degrees from the vertical in circumferential and radially inward directions relative to the central axis, and the second outlet 50 may be oriented up to about 35 degrees from the vertical in circumferential and radially inward directions. Using multiple outlets assists in dispersing more materials to pumps 14. Also, having an outlet such as 50 pointing a bit more circumferentially helps create rotation within container 12, thereby causing the sewage to rotate within container and bringing more of the sewage beneath one of the outlets to further disperse the floating materials.

It should be understood that the nozzle examples above are only one example of possible nozzle locations and angles. For example, one nozzle could point downward parallel to central axis, and one could be angled circumferentially. One, both, or neither nozzle may be angled radially. Each nozzle may include only one outlet. Only one nozzle may be provided, with one, two or more outlets. Further outlets may be provided by other nozzles and/or outlets along the conduit. Center of spray of outlet 48 thus may be angled from 0 to about 20 degrees, radially and/or circumferentially (see angle a in FIG. 7-9). Center of spray of outlet 50 may be angled from about 15 to about 40 degrees, radially and/or circumferentially (see angle b in FIGS. 7-9). Also, radial angling may be inward or outward depending on the size of the spray device (in particular the length of conduit 36) and the relative size of container 12. Thus, depending on the particular application, many variations in the number and spacing of the nozzles, outlets, etc. are possible.

Spray device 16 may be mounted to guide rails 20 by adjustable mounts 52. As illustrated, mounts 52 are located on a rod 54 connected to cross piece 46. Therefore, spray device 16 has a rough H-shape. Such shape is provided in view of the fact that guide rails 20 are usually toward the side of a container 12, and it is desired to move the spray nozzles 34 toward the center. It should be understood that other overall shapes for spray device 16 are possible.

Mounts 52 may be slidable along rod 54 and fixed in place, for example by a set screw, clamp or the like, so as to grip guide rods 20 and thereby hold spray device 16 at a desired height within container 12. Further structure, such as a set screw, clamp or the like may be used to each mount 52 to a respective guide rods 20, if desired. Alternatively, a simple frictional squeeze can be used to hold spray device 16 to guide rods 20, once the width of mounts 52 is set along rod 54. It should be understood that other mounting structures can be used, and spray device need not be mounted to guide rods.

A control valve assembly 60 is located between source of liquid 32 and spray device 16, and is in communication with the spray controller 40. The controller 40 causes control valve assembly 60 to open and close allowing liquid to flow to spray device 16 and out nozzles based on inputs from sensors 42 and 44 (and possibly 26 and 28) within container 12. As illustrated, control valve assembly 60 includes a one-way (back-flow prevention) valve 62, a solenoid valve 64, a pressure control valve 66, and one or more shut-off valves 68 mounted in an s-shaped path within a frame 70. Inlet 72 is connected to source of liquid 32 and outlet 74 is connected to a connector 78 on spray device 16 by a conduit 76, such a as a hose or pipe. The flow order of the valves in assembly 60 may be altered from that shown. Solenoid valve 64 is usually in a closed condition unless opened by controller 40 because sensor 42 signals that liquid has fallen to that level within container 12. Pressure control valve 66 is adjustable to achieve a desired flow and therefore spray intensity in view of the mains pressure and particular application. Control valve assembly 60 can be deployed as a unit in both new installations and retrofits.

FIG. 10 shows an alternative pumping station 10' in which the source of liquid 32 from the embodiment of FIGS. 1-9 is replaced by liquid pumped from within container 12 by a second pump 14'. Thus, first pumps 14 still function to empty pump station 10' as noted above, and sensors 26,28 and pump controller 30 may still be employed for as noted above. Spray member 16' includes a conduit member 36' and at least one nozzle 34'. As shown two such nozzles 34' are used, but other numbers could also be used. Second conduit 76' carries liquid from second pump 14' to conduit member 36' via connector 78', although a more direct path may be employed from second pump 14' to nozzle 34'. If desired, each nozzle 34' could have its own dedicated pump 14' and second conduit 76'.

Second pump 14' may be connected to sensors 42',44' and sprayer controller 40', as noted above. Use of a separate sprayer controller 40' for controlling second pump 14' may in some cases allow for easier retrofit installation of spray member 16 in an existing container 12 with existing first pumps 14 and their own controller 30 and sensors 26,28. Alternatively, if desired, controllers 30' and 40' may be housed within a single controller unit or housing, which can be used in an initial installation or retrofit. Second pump 14' may be placed within container 12 either attached to or independent from structure such as rods 20.

The disclosed structures can be used to carry out many methods of agitating floating matter on sewage within a sewage system component, such as a pumping station. One such method includes sensing that the pumping station 10' is filled to a first level 26; pumping sewage from the pumping station using a first pump after the sensing step; sensing when, during the pumping step, the sewage level has dropped to a predetermined level 42 lower than the first level 26; spraying a liquid pumped from the sewage system component using a second pump, during the pumping step and after the sensing of the predetermined level, with a nozzle 34 located above the predetermined level downwardly and circumferentially within the pumping station with enough force to disperse floating matter and cause rotation within the pumping station; and continuing to operate the first pump and the second pump until the sewage level has dropped to a second level 28,44 lower than the predetermined level.

As an example, in a system with mains pressure at around 60 psi, a spray device may run for about 6 seconds at a flow rate of 5 gallons per minute as the sewage level passes from the predetermined level to the second level. This is with the spray device about 12 inches above the pumps and spraying for about the final 6 inches worth of drainage from container 12. If a pump 14' is used to pump spray liquid from container 12, the pump rating and the head height of spray device 16' can be used to calculate a desired spray rate and duration of operation.

Of course these parameters can readily be adjusted depending on type of container, type of waste flow experienced, water pressure, number of nozzles and outlets, size and type of nozzle outlet, etc. Controller 30'40' may cause pump 14' and spray device 16' to operate each time container 12 is emptied or only sometimes (either by keeping a count, or by relying on a timer or sensor to detect buildup of floating material, clogs or flow rates through pumps, etc.). Thus, many modes of operation are possible, and controller 40,40' and/or controller 30,30' may direct the system to operate according to one or more stored routines.

It should be understood that in such method and using such structure all floating material will not be dispersed and pumped out each cycle. However, sufficient materials will be pumped out that manual or chemical cleaning can be substantially reduced or eliminated. A new equipment installation or retrofit installation is possible. The cost of the spray device 16,16', controllers 30,30' and 40, 40', sensors 42 and 44, pump 14', etc., can be rapidly recouped by virtue of the improved performance and reduced cost of operation of the resulting pumping station system including subject matter disclosed herein.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. Thus, while particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

I claim:

1. A sewage system component comprising:

a container for receiving a flow of sewage, the container defining a central axis;

a controller;

a first device start sensor and a second device start sensor each in communication with the controller, the first device start sensor sending a first start signal to the controller when the first device start sensor senses that the sewage level has reached a first height;

a device stop sensor in communication with the controller;

at least one first pump in the container for pumping sewage out of the container, the controller causing the first pump to pump sewage out of the container after receiving the first start signal until the sewage is at a second height lower than the first height;

a spray device mounted in the container at a predetermined height below the first height and above the second height; and a second pump in the container for pumping liquid from the sewage in the container to the spray device based on communications between the second device start sensor, the device stop sensor, and the controller, the second device start sensor sending a second start signal to the controller when the second device start sensor senses that the sewage level has fallen to a height below the predetermined height while the first pump is pumping, the controller causing the second pump to pump liquid to the spray device to start spraying after receiving the second start signal, the device stop sensor sending a stop signal to the controller when it senses that the sewage level has fallen to the second height while the first pump is pumping, the controller causing the second pump to stop pumping liquid to the spray device to stop spraying after receiving the stop signal, the spray device having a nozzle with a spray pattern with a center along a line directed generally downward and non-parallel to the central axis and directed generally tangential to a circle around the central axis from a viewpoint along the central axis above the nozzle, operation of the spray device dispersing floating material on the sewage surface and creating a rotational flow around the central axis to assist the first pump in removing such material when the first pump pumps the sewage.

2. The sewage system component of claim 1, wherein the spray device includes two of the nozzles located on opposite sides of the central axis.

3. The sewage system component of claim 1, wherein the center of the spray pattern of the nozzle is oriented at least about 10 degrees from the vertical in a circumferential direction relative to the central axis.

4. The sewage system component of claim 3, wherein the center of the spray pattern of the nozzle is oriented at least about 10 degrees from the vertical in a radially inward direction relative to the central axis.

5. The sewage system component of claim 1, wherein the spray device includes a conduit member and two of the nozzles, each nozzle being mounted at a respective end of the conduit member on opposite sides of the central axis.

6. The sewage system component of claim 5, further including a second conduit member extending from the second pump to the conduit member to supply the liquid to the nozzles.

* * * * *